US007834561B2

(12) United States Patent
Fong et al.

(10) Patent No.: US 7,834,561 B2
(45) Date of Patent: Nov. 16, 2010

(54) SYSTEMS AND METHODS FOR POWERING A LIGHT EMITTING DIODE LAMP

(75) Inventors: Vincent L. Fong, Cupertino, CA (US); Yong You, Shanghai (CN); Daiwei Fan, Shanghai (CN); Jin Wang, Shanghai (CN)

(73) Assignee: Pacific Tech Microelectronics (KY)

( * ) Notice: Subject to any disclaimer, the term of this patent is extended or adjusted under 35 U.S.C. 154(b) by 377 days.

(21) Appl. No.: 12/024,555

(22) Filed: Feb. 1, 2008

(65) Prior Publication Data

US 2009/0195190 A1 Aug. 6, 2009

(51) Int. Cl.
*H05B 37/02* (2006.01)

(52) U.S. Cl. ..... 315/307; 315/294; 315/360

(58) Field of Classification Search ..... 315/209 R, 315/291, 294, 299, 307, 360; 363/21.12, 363/21.15–21.18, 97

See application file for complete search history.

(56) References Cited

U.S. PATENT DOCUMENTS 7,561,452 B2 * 7/2009 Mednik et al. ..... 363/97
2007/0188114 A1 * 8/2007 Lys et al. ..... 315/308
2008/0192514 A1 * 8/2008 Zhou et al. ..... 363/21.12
2010/0052569 A1 * 3/2010 Hoogzaad et al. ..... 315/294
2010/0148697 A1 * 6/2010 Bayat et al. ..... 315/294

* cited by examiner

*Primary Examiner*—Douglas W Owens
*Assistant Examiner*—Tung X Le
(74) *Attorney, Agent, or Firm*—Chad R. Walsh; Fountainhead Law Group PC

(57) ABSTRACT

In one embodiment, the present invention includes an electronic circuit for providing a power current to an LED lamp. The electronic circuit comprises a logic drive circuit, a VCO, a power switch, and a first current sensor. The VCO is coupled to provide a first logic control signal to the logic drive circuit. The power switch has a first terminal and second terminal coupled to deliver the power current to the LED lamp and a control terminal coupled to receive a power control signal from the logic drive circuit. The first current sensor is coupled to sense a peak current passing through the power switch and coupled to provide a second logic control signal to the logic drive circuit.

18 Claims, 6 Drawing Sheets

SYSTEMS AND METHODS FOR POWERING A LIGHT EMITTING DIODE LAMP

BACKGROUND

The present invention relates to powering a lamp, and more particularly, to systems and methods for powering a light emitting diode lamp.

The more efficient use of energy has become more important as the cost of energy has increased. The world uses a significant portion for lighting. Light emitting diodes (LEDs) have a long life span and are more efficient in producing light than incandescent and florescent lamps, but the cost per lumen in providing an LED lighting solution has been historically high. Advances in LED illumination have improved the price per lumen, but the need for drive circuitry and power supplies keeps the price per lumen relatively high and therefore hinders the adoption of LED lamps.

The present invention solves these and other problems with systems and methods for powering a light emitting diode lamp.

SUMMARY

Embodiments of the present invention improve systems and methods for powering a light emitting diode lamp. In one embodiment, the present invention includes an electronic circuit for providing a power current to an LED lamp. The electronic circuit comprises a logic drive circuit, a voltage controlled oscillator (VCO), a power switch, and a first current sensor. The voltage controlled oscillator is coupled to receive a first reference voltage and coupled to provide a first logic control signal to the logic drive circuit. The first logic control signal includes an activation component. The power switch has a first terminal and second terminal coupled to deliver the power current to the LED lamp and a control terminal coupled to receive a power control signal from the logic drive circuit. The power control signal includes a first component and a second component. The first current sensor is coupled to sense a peak current passing through the power switch and coupled to provide a second logic control signal to the logic drive circuit. The second logic control signal includes a deactivation component when the peak current reaches a first value. The logic drive circuit provides the first component to the power switch and in accordance therewith closing the power switch. The first component is provided in response to the voltage controlled oscillator providing the activation component to the logic drive circuit. The logic drive circuit provides the second component to the power switch, and in accordance therewith opening the power switch. The second component is provided in response to the current sensor providing the deactivation component to the logic drive circuit. The first reference voltage controls a frequency of the first logic control signal provided by the voltage controlled oscillator.

In one embodiment, the logic drive circuit includes a set/reset latch.

In one embodiment, the electronic circuit further comprises a transformer. The transformer comprises a primary winding and a secondary winding. The primary winding has a first terminal coupled to a power source and a second terminal coupled to the first terminal of the power switch. The secondary winding having a first terminal and second terminal coupled to provide the power current to the LED lamp.

In one embodiment, the power switch includes multiple MOSFET devices coupled in parallel on an integrated circuit. The current sensor includes a sense MOSFET matching at least one of the multiple MOSFET devices. The sense MOSFET has a first terminal coupled to the first terminal of the power switch, a second terminal, and a control terminal coupled to the control terminal of the power switch. The second terminal of the sense MOSFET provides a sensed current corresponding to the peak current passing though the power switch.

In one embodiment, the electronic circuit further comprises a second current sensor and a comparison circuit. The second current sensor is coupled to sense the power current passing through the LED lamp and coupled to provide the first reference voltage. The first reference voltage corresponds to the power current. The comparison circuit is coupled to compare the first reference voltage to a second reference voltage and provide an enable signal to the voltage controlled oscillator. The voltage controlled oscillator is enabled as long as the first reference voltage is less than the second reference voltage.

In one embodiment, the electronic circuit further comprises a transformer and an averaging circuit. The transformer comprises a primary winding, a secondary winding, and an auxiliary winding. The primary winding has a first terminal and a second terminal. The first terminal is coupled to a power source and the second terminal coupled to the first terminal of the power switch. The secondary winding has a first terminal and second terminal that are coupled to provide the power current to the LED lamp. The auxiliary winding has a first terminal and a second terminal. The averaging circuit is coupled to receive a sense current from the first terminal and the second terminal of the auxiliary winding and coupled to provide the first reference voltage. The auxiliary winding and the averaging circuit form the second current sensor.

In one embodiment, the electronic circuit further comprises a transformer, a phototransistor, and an averaging circuit. The transformer comprises a primary winding and a secondary winding. The primary winding has a first terminal and a second terminal. The first terminal is coupled to a power source and the second terminal is coupled to the first terminal of the power switch. The secondary winding has a first terminal and second terminal coupled to provide the power current to a plurality of light emitting diodes coupled in series. The phototransistor has a first terminal, a second terminal, and a control terminal. The control terminal is coupled to receive a first light from at least one light emitting diode of the plurality of light emitting diodes coupled in series. The averaging circuit is coupled to receive a sense current from the first terminal and the second terminal of the phototransistor and coupled to provide the first reference voltage. The phototransistor and the averaging circuit form the second current sensor. The sense current corresponds to the power current. The LED lamp includes at least one light emitting diode of the plurality of light emitting diodes.

In one embodiment, one light emitting diode of the plurality of diodes emits said first light and said one light emitting diode and said photo transistor form an opto-isolator device.

In one embodiment the present invention includes a method for powering a lamp comprising closing a power switch, sensing a peak current, and opening the switch. The closing of the power switch occurs periodically and at a first portion of a first period. The closing and in accordance therewith delivers a power current to the LED lamp. The peak current passing through the power switch is sensed. The power switch is opened when the peak current reaches a first value. The opening of the power switch occurs prior to an end portion of the first period.

In one embodiment, the delivering the power current comprises transforming a switching current passing through the power switch into the power current passing through the LED lamp. This transforming electrically isolates the power source from the LED lamp.

In one embodiment, the method further comprising sensing, converting the sensed current, adjusting the first period, comparing the reference voltages, and selectively disabling the closing of the power switch. The power current is sensed which results in a sensed power current. The sensed power current is converted into a first reference voltage having a first value corresponding to an average power current. The first period is adjusted according to the first value of the first reference voltage. The first reference voltage is compared with a second reference voltage having a first value. The closing of the power switch is selectively disabled when the first value of the first reference voltage exceeds the first value of the second reference voltage. The selectively disabling the closing of the power switch reduces the average power current and results in the first reference voltage adjusting such that the first value of the first reference voltage matches the first value of the second reference voltage.

In one embodiment, the sensing the power current comprises transforming the power current passing through the LED lamp into the sensed power current, wherein the transforming the power current electrically isolates the power source from the LED lamp.

In one embodiment, the sensing the power current comprises sensing light from at least one of the plurality of light emitting diodes resulting in a sensed light, and converting the sensed light into the sensed power current. The sensing light electrically isolates the power source from the LED lamp.

The following detailed description and accompanying drawings provide a better understanding of the nature and advantages of the present invention.

DETAILED DESCRIPTION

Described herein are techniques for systems and methods for powering a light emitting diode lamp. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include obvious modifications and equivalents of the features and concepts described herein.

Figure 1:
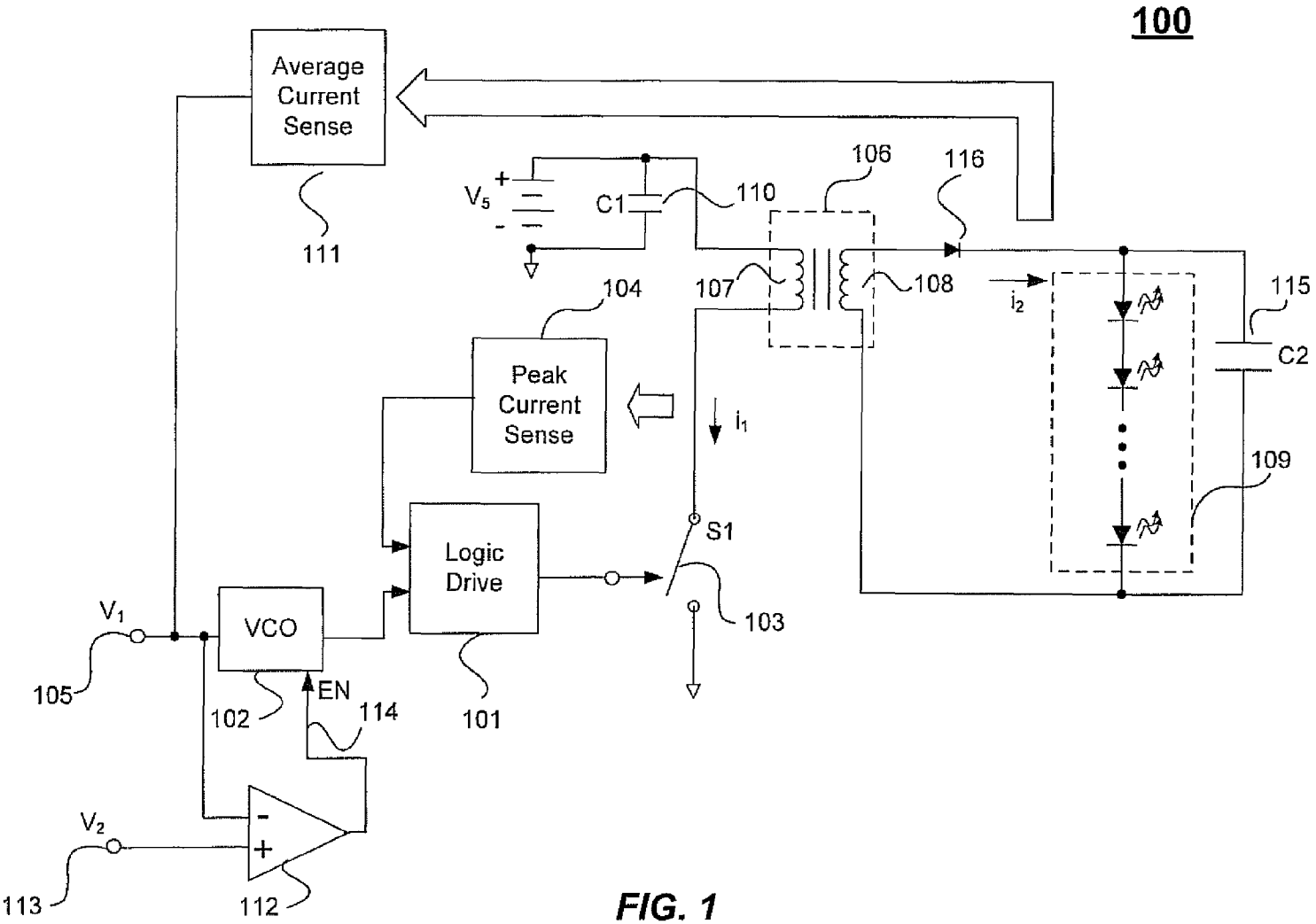
FIG. 1 illustrates an electronic circuit according to one embodiment of the present invention.

FIG. 1 illustrates an electronic circuit 100 according to one embodiment of the present invention. Electronic circuit 100 includes a logic drive circuit 101, a voltage controlled oscillator (VCO) 102, a power switch 103, a current sensor 104, a transformer 106, a diode 116, and a LED lamp 109. The power switch 103 may be a transistor such as a NMOS device, a PMOS, or an IGBT (isolated gate bipolar transistor). The power switch 103 may include a MOSFET device or multiple MOSFET devices.

The power switch 103 is coupled to deliver a power current $i_2$ to a lamp comprising a plurality of light emitting diodes coupled in series, referred to herein as the LED lamp 109. The power switch 103 has a first terminal, a second terminal, and a control terminal. The first terminal of the power switch 103 is coupled to a first terminal of the primary winding 107 of the transformer 106. A second terminal of the primary winding 107 of the transformer 106 is coupled to a first terminal of capacitor 110 and coupled to a first terminal of the power supply $V_S$. The second terminal of the power switch 103 is coupled to the second terminal of capacitor 110 and the second terminal of the power supply $V_S$. In this embodiment, the second terminal of the power supply $V_S$ is also coupled to ground. The secondary winding 108 of transformer 106 is coupled to deliver a power current $i_2$ to the LED lamp 109 when the power switch 103 is periodically switched. The diode 116 has a first terminal coupled to a first terminal of the secondary winding 108 and a second terminal coupled to a first terminal of the LED lamp 109 and a first terminal of capacitor 115. The second terminal of the secondary winding 108 is coupled to a second terminal of the LED lamp 109 and the second terminal of the capacitor 115.

The control terminal of the power switch 103 is coupled to receive a power control signal from the logic drive circuit 101. The power control signal includes a first component that closes the power switch 103 and a second component that opens the power switch 103. The logic drive circuit 101 may include a latch such as a set-reset latch or a JK latch with a preset input and clear input, for example. An input of the logic drive circuit 101 is coupled to an output of the VCO 102. The VCO 102, in this embodiment, generates a square wave at a frequency governed by a first reference voltage $V_1$ at terminal 105. In this embodiment, a first logic control signal is the square wave and an activating component is a rising edge of the square wave. The activating component sets a latch within the logic drive circuit 101. In response to the set latch, the logic drive circuit 101 provides the first component of the power control signal to close the power switch 103. The first component of the power signal may be a voltage or a current which closes the power switch 103, for example. The closing of the power switch 103 allows a current $i_1$ to charge a primary winding 107 of a transformer 106. This generates a power current $i_2$ in the secondary winding 108 which passes through the LED lamp 109. The current sensor 104 is coupled to provide a second logic control signal to the logic drive circuit 101. The current sensor 104 may be a sense transistor or may utilize a sense resistor, for example. The second logic control signal includes a deactivation component when the current sensor 104 senses a peak current $i_1$ having a first value. In this embodiment, the deactivation component resets a latch within the logic drive circuit 101. In response to the reset latch, the logic drive circuit 101 provides the second component of the power control signal to open the power switch 103. This results in the current through the transformer decreasing. Additional current from capacitor 115 may help to maintain a stable average current through the LED lamp 109. The switch 103 is switched on once more on the next rising edge of the VCO 102 signal. Capacitor 110 may help maintain a stable reference voltage $V_S$.

The electronic circuit 100 further includes a second current sensor 111 and a comparator 112. The second current sensor 111 senses the power current $i_2$ delivered to the LED lamp 109 and provides the first reference voltage $V_1$ to the VCO 102.

The first reference voltage corresponds to the power current $i_2$. The first reference voltage governs the frequency of the VCO 102 and therefore the frequency of the switching of the power switch 103. Comparator 112 has an inverting terminal coupled to receive the first reference voltage $V_1$ and a non-inverting terminal coupled to receive a second reference voltage $V_2$. An output of the comparator 112 is coupled to provide an enable signal to the VCO 102. The VCO 102 is enabled as long as the first reference voltage is less than the second reference voltage. Therefore, the first reference voltage rises and increases the frequency of the VCO, the switching frequency of S1, and the average power current. The average power current will increase until the corresponding first reference voltage value exceeds the value of the second reference voltage. At this time the comparator will selectively disable the VCO 102, and subsequently the switching of the power switch 103, such that the average power current reduces. This results in the first reference voltage value adjusting such that the value matches the value of the second reference voltage. The level of matching depends on several factors including the input offset voltage of the comparator 112. The VCO 102, the logic drive circuit 101, the power switch 103, the transformer 106, the diode 116, the LED lamp 109, and the second current sensor 111 form an average power current control loop (i.e., a current control loop). The average power current loop controls the average current passing through the LED lamp 109. The logic drive circuit 101, the voltage controlled oscillator (VCO) 102, the power switch 103, the current sensor 104, the current sensor 111, and the comparator 112 may be manufactured on one integrated microchip.

Figure 2:
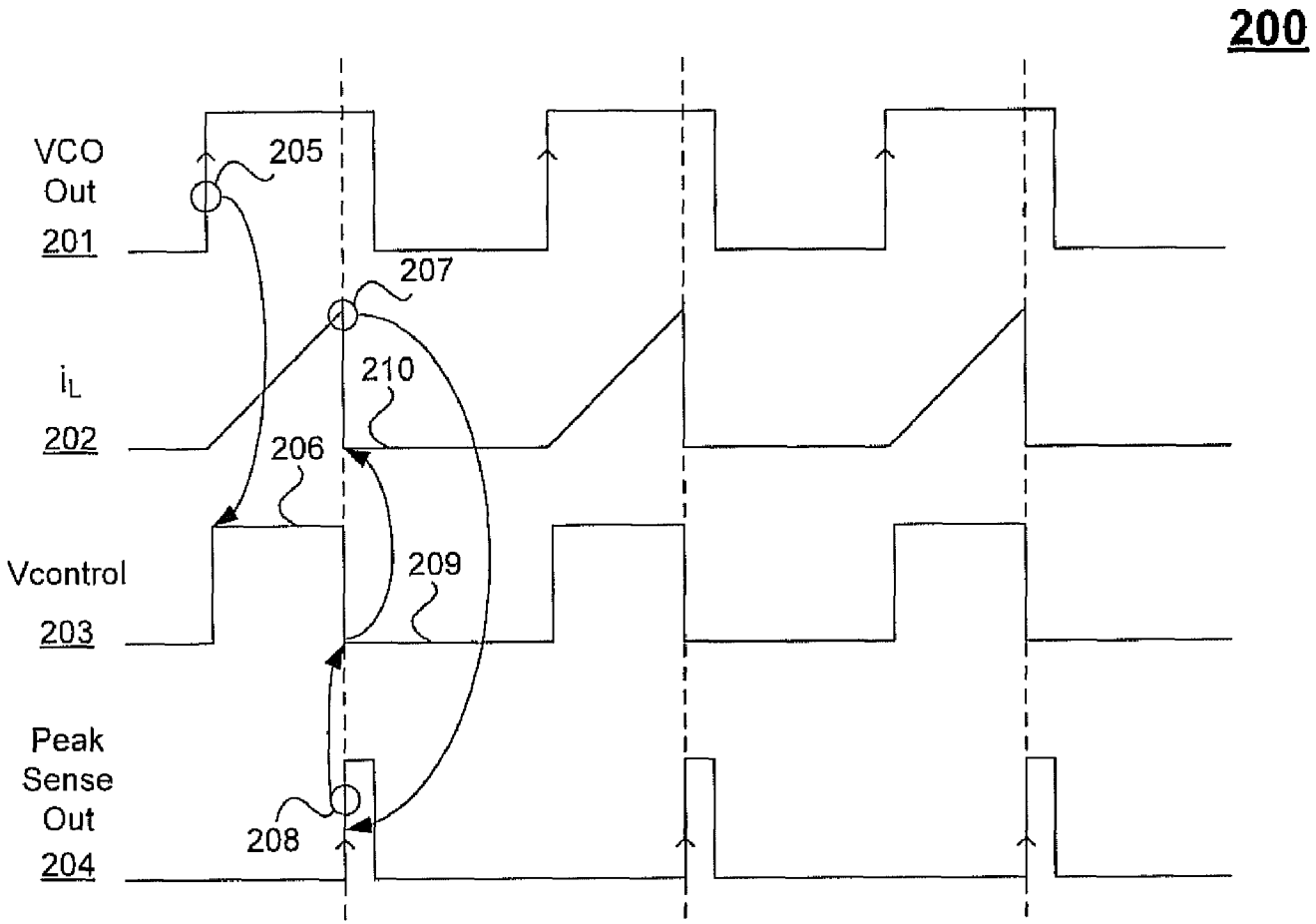
FIG. 2 illustrates a signal diagram associated with the peak current control of the embodiment of FIG. 1.

FIG. 2 illustrates a signal diagram 200 associated with the peak current control of the embodiment of FIG. 1. Signal diagram 200 includes a waveform of the VCO out signal 201, a waveform of the peak current $i_1$ 202 passing through the power switch 103, a waveform of the power control signal $V_{control}$ 203 including a first component 206 and a second component 209, and a waveform of the peak sense out signal 204 generated by the first current sensor 104. The VCO out signal 201 is a first logic control signal in this embodiment, and an activating component 205 is the rising edge of the first logic control signal. The peak sense out signal 204 is the second logic control signal in this embodiment, and a deactivating component 208 is the rising edge of the second logic control signal. In response to the activating component 205, the logic drive circuit 101 generates a first component 206 of the power control signal 203 to close power switch 103. This allows the peak current $i_1$ 202 to begin charging the primary winding 107. Peak current $i_1$ is transformed into a current $i_2$ passing through the secondary winding 108. The peak current $i_1$ 202 increases until the signal reaches a first value 207. After reaching the first value 207, the first current sensor 104 provides the deactivating component 208 of second logic control signal, peak out sense 204, to the logic drive circuit 101. In response to the deactivating component 208, the logic drive circuit 101 generates the second component of the power control signal which opens the power switch 103. This halts the flow of current $i_1$ 210 and allows the current $i_2$ to decrease. This switching of the power switch 103 continues in a similar manner for each subsequent period. In this example, the electronic circuit 100 is operating in a discontinuous current mode. The rate at which the current $i_1$ ramps is dependant on a variety of factors including the characteristics of capacitor 110 and the primary winding 107 of transformer 106.

Figure 3:
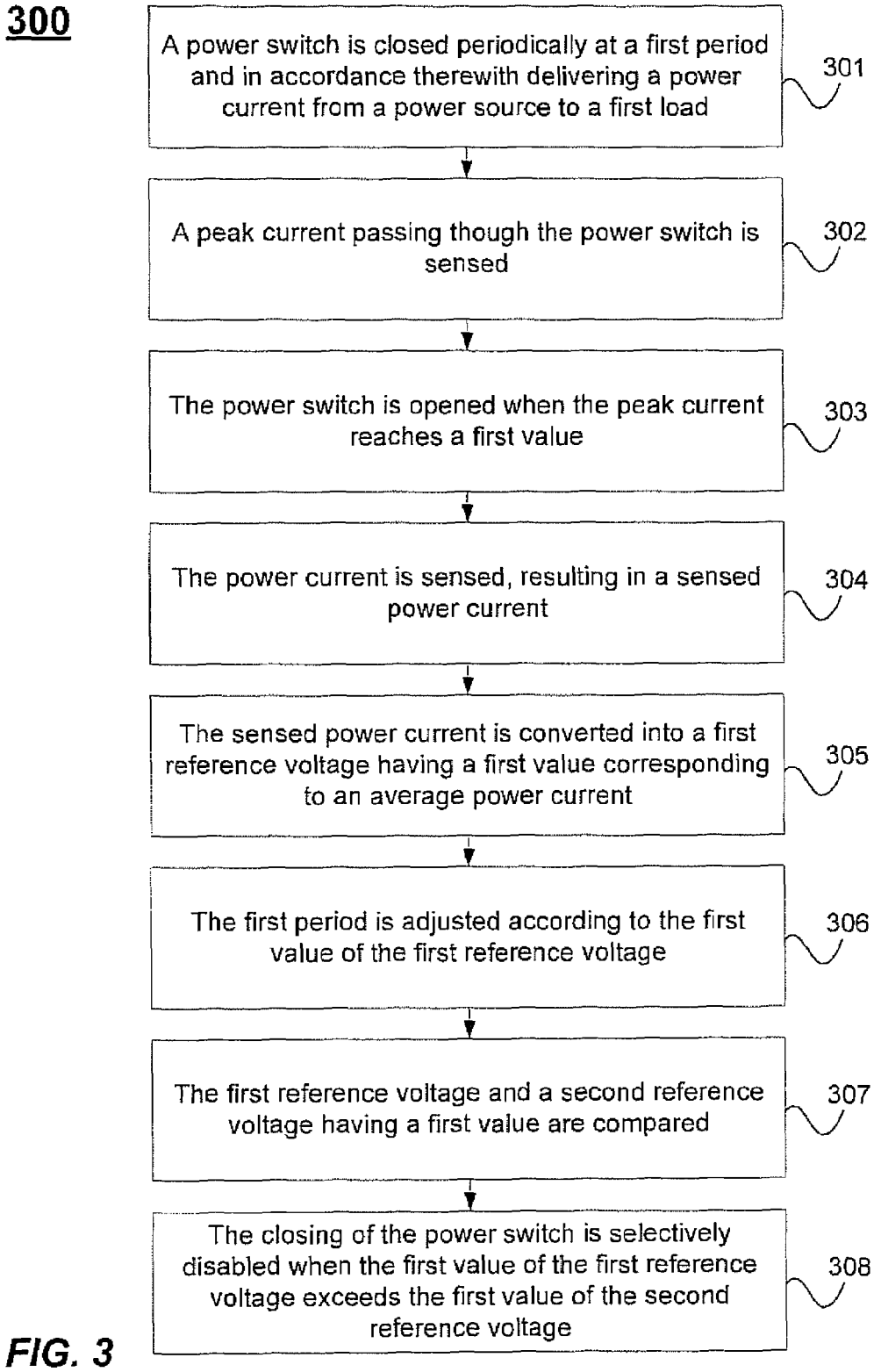
FIG. 3 illustrates a method according to one embodiment of the present invention.

FIG. 3 illustrates a method 300 according to one embodiment of the present invention. At 301, a power switch is closed periodically at a first period. The periodic switching of the switch delivers a power current from a power source to a LED lamp. The delivery of the power current may include transforming a switching current passing through the power switch into the power current passing through the LED lamp. The transforming electrically isolates the power source from the LED lamp. The transforming may be a transformer which may scale the switching current. The closing of the switch may include a VCO or similar circuit which translates a signal to an oscillating waveform such as a square wave, for example.

At 302, a peak current, passing through the power switch, is sensed. The sensing may be accomplished by directly measuring a voltage across some small resistance or by tapping off a sense current proportional to the peak current passing through the power switch.

At 303 the power switch is opened when the peak current reaches a first value. The opening of the switch occurs prior to an end portion of the first period.

At 304, the power current is sensed, resulting in a sensed power current. This sensed power current may be a current which is tapped off an auxiliary winding of a transformer used to isolate the power supply, for example.

At 305, the sensed power current is converted into a first reference voltage having a first value corresponding to an average power current. The sensed power current may be integrated in order to get an average value. The conversion may include transforming the power current passing through the LED lamp into the sensed power current. The transforming the power current electrically isolates the power source from the LED lamp. The sensing the power current may include sensing light from at least one of a plurality of LEDs. The LED lamp comprises the plurality of LEDs. The resulting sensed light may be converted into the sensed power current. The sensing light electrically isolates the power source from the LED lamp.

At 306, the first period is adjusted according to the first value of the first reference voltage.

At 307, the first reference voltage is compared with a second reference voltage having a first value.

At 308, the closing of the power switch is selectively disabled when the first value of the first reference voltage exceeds the first value of the second reference voltage. The selectively disabling the closing of the power switch reduces the average power current and results in the first reference voltage adjusting such that the first value of the first reference voltage matches the first value of the second reference voltage.

Figure 4:
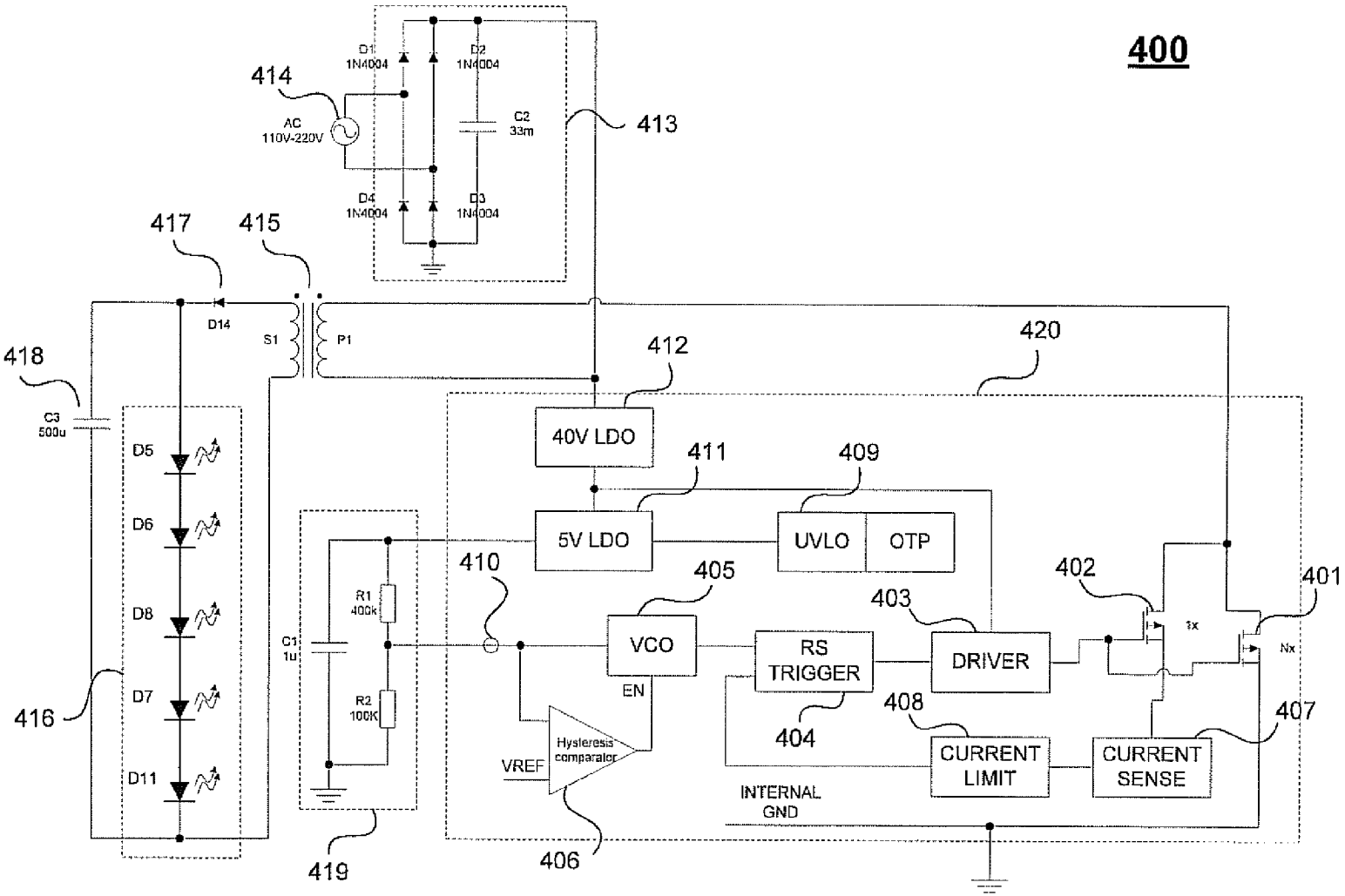
FIG. 4 illustrates an electronic circuit according to one embodiment of the present invention.

FIG. 4 illustrates an electronic circuit 400 according to one embodiment of the present invention. The electronic circuit 400 includes an integrated electronic circuit 420. Integrated electronic circuit 420 includes a power transistor 401, a sense transistor 402, a driver circuit 403, a RS trigger circuit 404, a VCO 405, a hysteresis comparator 406, a first reference voltage node 410, a 5V LDO regulator 411 with a over voltage lockout and a over temperature protection circuit 409, and a 40V LDO regulator 412. An AC power source 414 provides power the integrated circuit 420. This power source maybe a 110V or 220V source available to most residential and commercial buildings. A full wave rectifier 413 provides an unregulated DC voltage for the 40V regulator 412 to provide a lower regulated voltage suitable for the 5V regulator 411 to provide power to the other circuitry within integrated circuit 420. The regulated 40V provided by the 40V LDO regulator 412 is used to drive the power transistor 401 and the sense transistor 402. In this embodiment the 5 v regulator 411 is reduced by divider circuit 419 and provides the first reference voltage at node 410. This first reference voltage sets the frequency and therefore the period of the VCO 405. The VCO 405 provides a first logic control signal to the RS trigger 404. In this embodiment, the rising edge of the first logic control signal sets the trigger which generates a signal for the driver 403 to close the power switch 401. The power transistor 401 may be comprised of a plurality of matching transistors coupled in parallel. These matching transistors may have matching geometries and the sense transistor 402 may be a single transistor which also matches the geometries of the matching transistors. Sense transistor 402 and the power transistor 401 receive similar stimulus to their drain terminals and their gate terminals. The peak current passing from the first terminal to the second terminal of the sense transistor 402 corresponds to the peak current passing from the first terminal to the second terminal of the power transistor. The current sense transistor 402 and the current sense circuit 407 sense the peak current passing through the power transistor 401. The current sense circuit 407 provides a signal to the current limit circuit 408 which will provide a second logic control signal to the RS trigger circuit 404 when the current passing though the power transistor reaches a first value. The RS trigger circuit 404, in response to the second logic control signal, provides a signal to turn off the driver and subsequently, the power transistor turns off and no substantial current flows. The switching of the power switch on and off allows a primary winding of transformer 415 to transform the current to a power current on the secondary winding which provides power to the LED lamp 416. In this embodiment the LED lamp 416 comprises a plurality of light emitting diodes coupled in series. The transformer 415 isolates the power source 414 from the LED lamp 416. The value of the first reference voltage sets the average power current delivered to the LED lamp 416, and in this way the integrated circuit 400 provides a current to power the LED lamp 416.

Figure 5:
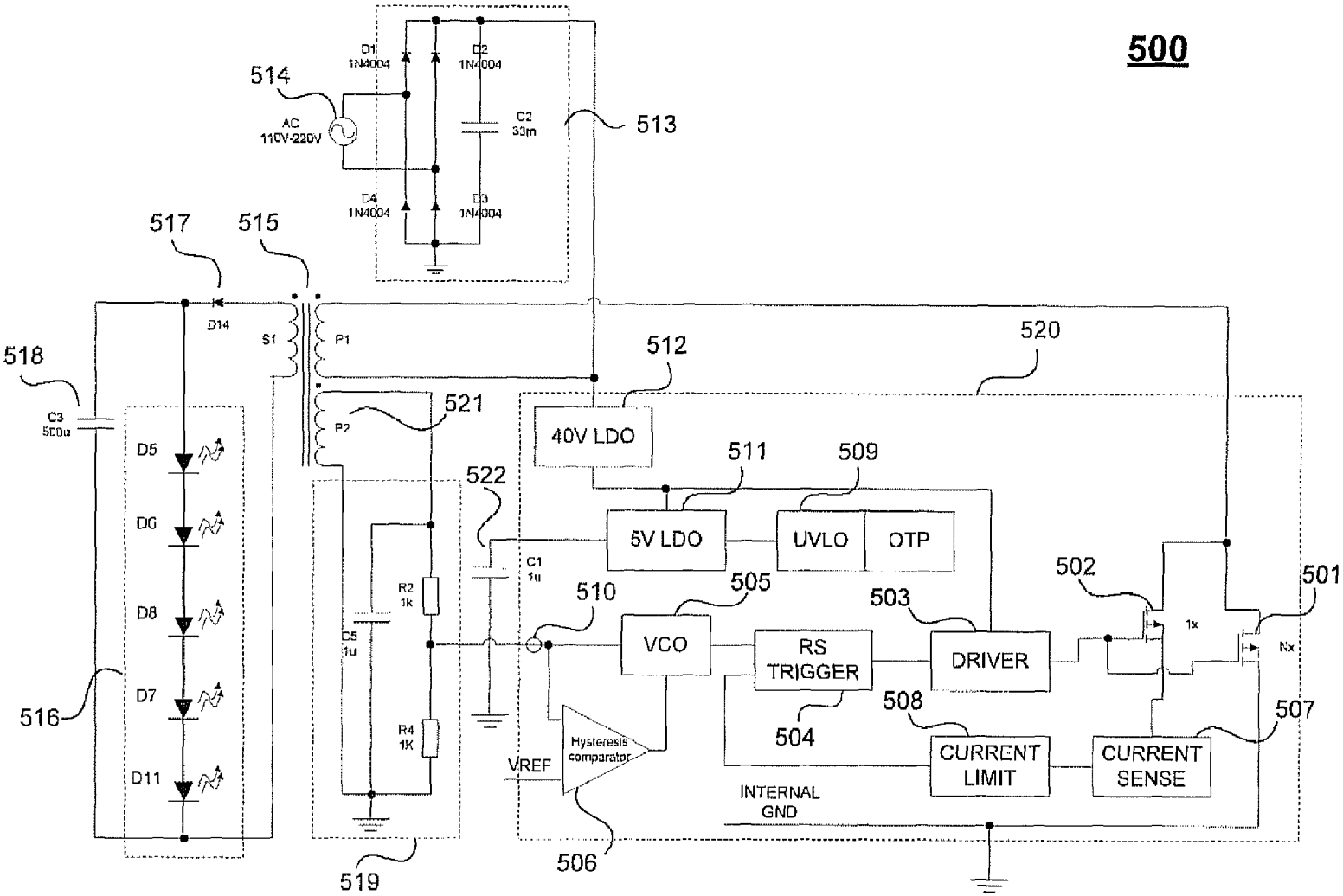
FIG. 5 illustrates an electronic circuit according to another embodiment of the present invention.

FIG. 5 illustrates an electronic circuit 500 according to another embodiment of the present invention. The electronic circuit 500 includes an integrated electronic circuit 520. Integrated electronic circuit 520 includes a power transistor 501 having a first terminal, a second terminal, and a control terminal, a sense transistor 502 having a first terminal, a second terminal, and a control terminal, a driver circuit 503, a RS trigger circuit 504, a VCO 505, a hysteresis comparator 506, a first reference voltage node 510, a 5V LDO regulator 511 with a over voltage lockout and a over temperature protection circuit 509, and a 40V LDO regulator 512. The AC power source 514 provides power to integrated circuit 520. This power source maybe a 110V or 220V source available to most residential and commercial buildings. The full wave rectifier 513 provides an unregulated DC voltage for the 40V regulator 512 to provide a lower regulated voltage suitable for the 5V regulator 511 to provide power to the other circuitry within integrated circuit 520. The regulated 40V provided by the 40V LDO regulator 512 is used to drive the power transistor 501 and the sense transistor 502. In this embodiment, the output of 5V regulator 511 is by passed by capacitor 522, and the second current sensor circuit 519 provides the first reference voltage at node 510. This first reference voltage sets the frequency and therefore the period of the VCO 505. The VCO 505 provides a first logic control signal to the RS trigger 504. In this embodiment, the rising edge of the first logic control signal sets the trigger which generates a signal for the driver 503 to close the power transistor 501. The power transistor 501 may be comprised of a plurality of matching transistors coupled in parallel. These matching transistors may have matching geometries and the sense transistor 502 may be a single transistor which also matches the geometries of the matching transistors. Sense transistor 502 and the power transistor 501 receive similar stimulus to their drain terminal and their gate terminals. The peak current passing from the first terminal to the second terminal of the sense transistor 502 corresponds to the peak current passing from the first terminal to the second terminal of the power transistor 501. The sense transistor 502 and the current sense circuit 507 sense the peak current passing through the power transistor 501. The current sense circuit 507 provides a signal to the current limit circuit 508 which provides a second logic control signal to the RS trigger circuit 504 when the current passing though the power transistor reaches a first value. The RS trigger circuit 504, in response to the second logic control signal, provides a signal to turn off the driver and subsequently, the power transistor 501 turns off and no substantial current flows. The switching of the power transistor on and off allows the primary winding of transformer 515 to transform the current to a power current on the secondary winding which provides power to the LED lamp 516. In this embodiment, the LED lamp 516 comprises a plurality of light emitting diodes coupled in series. In this embodiment, the transformer also includes an auxiliary winding 521 which provides a current corresponding to the power current provided to LED lamp 516. The auxiliary winding 521 and the second current sensor 519 provide a first reference voltage corresponding to the average power current passing though the LED lamp 516. The first reference voltage at point 510 rises and increases the frequency of the power switching which in turn increases the average power current delivered to the LED lamp 516. Comparator 506 compares the first reference voltage to a second reference voltage VREF. When the first value of the first reference voltage exceeds a first value of the second reference voltage the comparator sends a signal to disable the VCO 505. The value of the second reference voltage sets the average power current delivered to the LED lamp 516, and in this way the electronic circuit 500 provides a regulated current to power the LED lamp 516. The transformer 515 isolates the power source 514 from the LED lamp 516.

Figure 6:
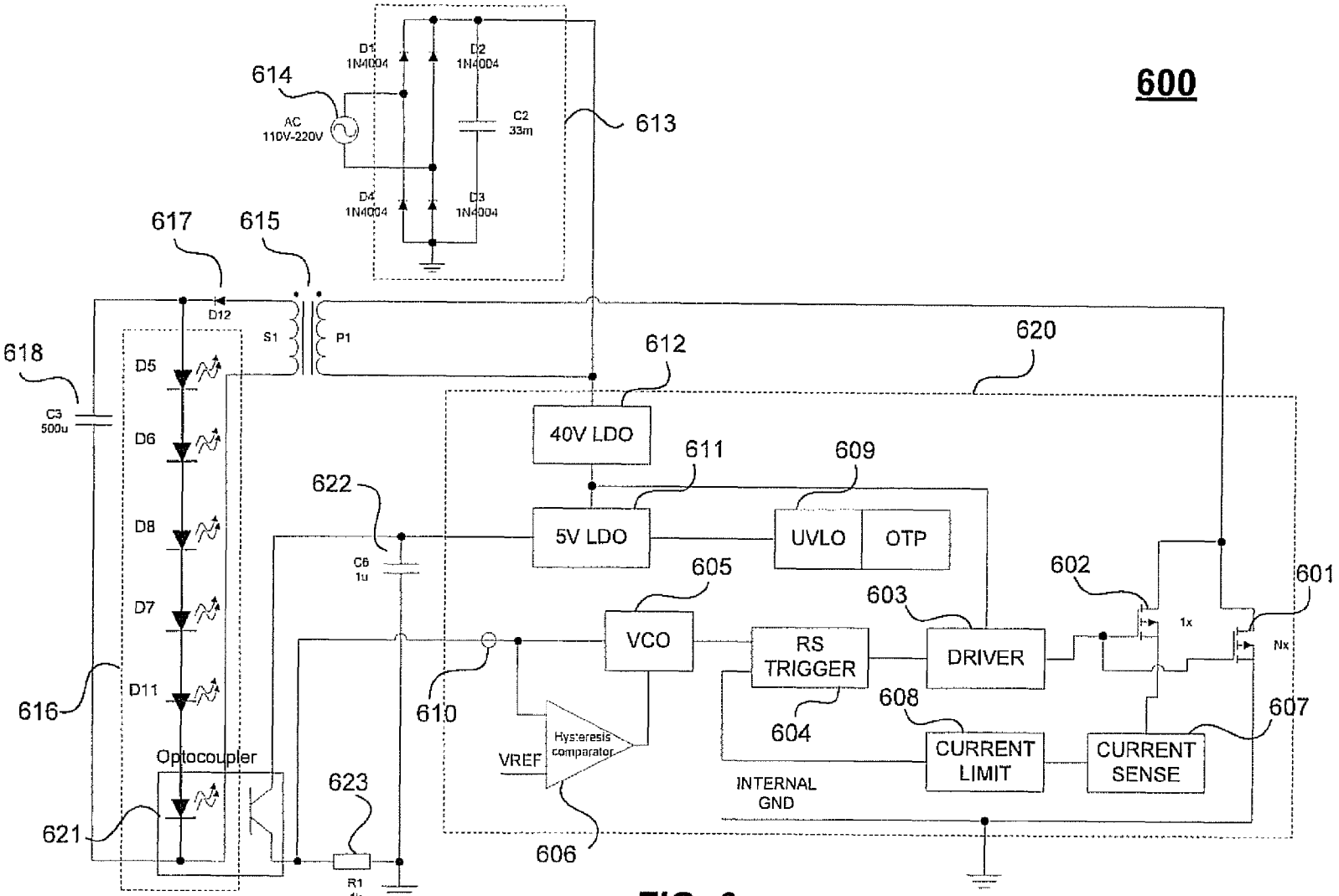
FIG. 6 illustrates an electronic circuit according to another embodiment of the present invention.

FIG. 6 illustrates an electronic circuit 600 according to another embodiment of the present invention. The electronic circuit 600 includes an integrated electronic circuit 620. Integrated electronic circuit 620 includes a power transistor 601 having a first terminal, a second terminal, and a control terminal, a sense transistor 602 having a first terminal, a second terminal, and a control terminal, a driver circuit 603, a RS trigger circuit 604, a VCO 605, a hysteresis comparator 606, a first reference voltage node 610, a 5V LDO regulator 611 with a over voltage lockout and a over temperature protection circuit 609, and a 40V LDO regulator 612. An AC power source 614 provides power the integrated circuit 620. This power source maybe a 110V or 220V source available to most residential and commercial buildings. A full wave rectifier 613 provides an unregulated DC voltage for the 40V regulator 612 to provide a lower regulated voltage suitable for the 5V regulator 611 to provide power to the other circuitry within integrated circuit 620. The regulated 40V provided by the 40V LDO regulator 612 is used to drive the power transistor 601 and the sense transistor 602. In this embodiment, the output of 5V regulator 611 is by passed by capacitor 622, and the second current sensor circuit 619 provides the first reference voltage at node 610. This first reference voltage sets the frequency and therefore the period of the VCO 605. The VCO 605 provides a first logic control signal to the RS trigger 604. In this embodiment, the rising edge of the first logic control signal sets the trigger which generates a signal for the driver 603 to close the power transistor 601. The power transistor 601 may be comprised of a plurality of matching transistors coupled in parallel. These matching transistors may have matching geometries and the sense transistor 602 may be a single transistor which also matches the geometries of the matching transistors. Sense transistor 602 and the power transistor 601 receive similar stimulus to their drain terminal and their gate terminals. The peak current passing from the first terminal to the second terminal of the sense transistor 602 corresponds to the peak current passing from the first terminal to the second terminal of the power transistor 601. The sense transistor 602 and the current sense circuit 607 sense the peak current passing through the power transistor 601. The current sense circuit 607 provides a signal to the current limit circuit 608 which provides a second logic control signal to the RS trigger circuit 604 when the current passing though the power transistor reaches a first value. The RS trigger circuit 604, in response to the second logic control signal, provides a signal to turn off the driver and subsequently, the power transistor 601 turns off and no substantial current flows. The switching of the power transistor on and off allows the primary winding of transformer 615 to transform the current to a power current on the secondary winding which provides power to the LED lamp 616. In this embodiment, the LED lamp 616 comprises a plurality of light emitting diodes coupled in series. In this embodiment, the circuit also includes an opto-coupler 621 having a phototransistor to sense a current corresponding to the power current provided to LED lamp 616. The phototransistor and a second sensor circuit comprising a 5V source voltage from regulator 611, a resistor 623, and a capacitor 622 form the second sensor and provide a first reference voltage corresponding to the average power current passing though the LED lamp 616. The first reference voltage rises and increases the frequency of the power switching which in turn increases the average power current delivered to the LED lamp 616. Comparator 606 compares the first reference voltage to a second reference voltage VREF. When the first value of the first reference voltage exceeds the first value of the second reference voltage the comparator sends a signal to disable the VCO 605. The value of the second reference voltage sets the average power current delivered to the LED lamp, and in this way the integrated circuit 600 provides a regulated current to power the LED lamp 616. The transformer 615 and the opto-isolator 621 isolate the power source 614 from the LED lamp 616.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims. The terms and expressions that have been employed here are used to describe the various embodiments and examples. These terms and expressions are not to be construed as excluding equivalents of the features shown and described, or portions thereof, it being recognized that various modifications are possible within the scope of the appended claims.

What is claimed is:

1. An electronic circuit for providing a power current to an LED lamp, the electronic circuit comprising:

a logic drive circuit;

a voltage controlled oscillator coupled to receive a first reference voltage and coupled to provide a first logic control signal to the logic drive circuit, wherein said first logic control signal includes an activation component;

a power switch having a first terminal and second terminal coupled to deliver the power current to the LED lamp and a control terminal coupled to receive a power control signal from the logic drive circuit, wherein said power control signal includes a first component and a second component; and a first current sensor coupled to sense a peak current passing through the power switch and coupled to provide a second logic control signal to the logic drive circuit, wherein the second logic control signal includes a deactivation component when the peak current reaches a first value, wherein the logic drive circuit provides the first component of the power control signal to said power switch, and in accordance therewith, closes said power switch, said first component provided in response to the voltage control oscillator providing the activation component to the logic drive circuit, wherein the logic drive circuit provides the second component of the power control signal to said power switch, and in accordance therewith, opens said power switch, said second component provided in response to the first current sensor providing the deactivation component to the logic drive circuit, and wherein the first reference voltage controls a frequency of the first logic control signal provided by the voltage controlled oscillator.

2. The electronic circuit of claim 1 wherein the logic drive circuit, the voltage controlled oscillator, the power switch, and the first current sensor are all integrated on a single chip.

3. The electronic circuit of claim 1 wherein the power switch is an NMOS device.

4. The electronic circuit of claim 1 wherein the power switch is an IGBT.

5. The electronic circuit of claim 1 wherein the logic drive circuit includes a set-reset latch.

6. The electronic circuit of claim 1 wherein the activation component is a rising edge.

7. The electronic circuit of claim 1 wherein the deactivation component is a rising edge.

8. The electronic circuit of claim 1 wherein the first current sensor includes a sense resistor.

9. The electronic circuit of claim 1 further comprising:

a transformer, the transformer comprising:

a primary winding having a first terminal and a second terminal, the first terminal coupled to a power source and the second terminal coupled to the first terminal of the power switch; and a secondary winding having a first terminal and second terminal coupled to provide the power current to a plurality of light emitting diodes coupled in series.

10. The electronic circuit of claim 1 wherein the power switch includes multiple MOSFET devices coupled in parallel on an integrated circuit, wherein the first current sensor includes a sense MOSFET matching at least one of the multiple MOSFET devices, the sense MOSFET having a first terminal coupled to the first terminal of the power switch, a second terminal, and a control terminal coupled to the control terminal of the power switch, wherein the sense MOSFET provides a sense current from the second terminal of the sense MOSFET, the sense current corresponding to a current passing though the power switch.

11. The electronic circuit of claim 1 further comprising:

a second current sensor coupled to sense the power current passing through the LED lamp and coupled to provide the first reference voltage, the first reference voltage corresponding to the power current; and a comparison circuit coupled to compare the first reference voltage to a second reference voltage and provide an enable signal to the voltage controlled oscillator, wherein the voltage controlled oscillator is enabled as long as the first reference voltage is less than the second reference voltage.

12. The electronic circuit of claim 11 further comprising:

a transformer, the transformer comprising:

a primary winding having a first terminal and a second terminal, the first terminal coupled to a power source and the second terminal coupled to the first terminal of the power switch;

a secondary winding having a first terminal and second terminal coupled to provide the power current to a plurality of light emitting diodes coupled in series;

an auxiliary winding having a first terminal and a second terminal; and an averaging circuit coupled to receive a sense current from the first terminal and the second terminal of the auxiliary winding and coupled to provide the first reference voltage, wherein, the auxiliary winding and the averaging circuit form the second current sensor, wherein the sense current corresponds to the power current.

13. The electronic circuit of claim 11 further comprising:

a transformer, the transformer comprising:

a primary winding having a first terminal and a second terminal, the first terminal coupled to a power source and the second terminal coupled to the first terminal of the power switch; and a secondary winding having a first terminal and second terminal coupled to provide the power current to a plurality of light emitting diodes coupled in series in said LED lamp;

a phototransistor having a first terminal, a second terminal, and a control terminal coupled to receive a first light from at least one light emitting diode of the plurality of light emitting diodes coupled in series; and an averaging circuit coupled to receive a sense current from the first terminal and the second terminal of the phototransistor and coupled to provide the first reference voltage, wherein the phototransistor and the averaging circuit form the second current sensor, and wherein the sense current corresponds to the power current.

14. The electronic circuit of claim 13 wherein one light emitting diode of the plurality of diodes emits said first light and said one light emitting diode and said photo transistor form an opto-isolator device.

15. A method for powering an LED lamp comprising:

closing a power switch periodically, the closing occurring at a first portion of a first period;

sensing a peak current passing through the power switch;

opening said power switch when the peak current reaches a first value, wherein the opening of said switch occurs prior to an end portion of the first period, and wherein the opening and closing of said power switch delivers a power current to the LED lamp, and wherein the first period is changed based on said power current;

sensing the power current, resulting in a sensed power current;

converting the sensed power current into a first reference voltage having a first value corresponding to an average power current;

adjusting the first period according to the first value of the first reference voltage;

comparing the first reference voltage with a second reference voltage having a second value; and selectively disabling the closing of the power switch when the first value of the first reference voltage exceeds the second value of the second reference voltage, wherein the selectively disabling the closing of the power switch reduces the average power current and results in the first reference voltage adjusting such that the first value of the first reference voltage matches the second value of the second reference voltage.

16. The method of claim 15 wherein the delivering the power current comprises:

transforming a switching current passing through the power switch into the power current passing through the LED lamp, wherein the transforming the switching current electrically isolates the power source from the LED lamp.

17. The method of claim 15 wherein the sensing the power current comprises:

transforming the power current passing through the LED lamp into the sensed power current, wherein the transforming the power current electrically isolates the power source from the LED lamp.

18. The method of claim 15 wherein the sensing the power current comprises:

sensing light from at least one of the plurality of light emitting diodes resulting in a sensed light; and converting the sensed light into the sensed power current, wherein the sensing light electrically isolates the power source from the LED lamp.

* * * * *